US007059984B2

(12) United States Patent
Vaeth

(10) Patent No.: US 7,059,984 B2
(45) Date of Patent: Jun. 13, 2006

(54) DEVICE AND METHOD FOR REGULATING THE TENSION OF A RUNNING WEB

(75) Inventor: Joerg Vaeth, Mering (DE)

(73) Assignee: Erhardt & Lerner GmbH, Augsburg (DE)

( * ) Notice: Subject to any disclaimer, the term of this patent is extended or adjusted under 35 U.S.C. 154(b) by 20 days.

(21) Appl. No.: 10/861,838

(22) Filed: Jun. 5, 2004

(65) Prior Publication Data

US 2004/0245363 A1 Dec. 9, 2004

(30) Foreign Application Priority Data

Jun. 6, 2003 (DE) ..... 103 26 133

(51) Int. Cl.
*F16H 7/18* (2006.01)
*F16H 7/08* (2006.01)
*F16H 7/22* (2006.01)

(52) U.S. Cl. ..... 474/101; 474/102; 474/106

(58) Field of Classification Search ..... 474/101, 474/102, 117, 85, 87, 139, 106
See application file for complete search history.

(56) References Cited

U.S. PATENT DOCUMENTS 4,478,595 A * 10/1984 Hayakawa et al. ..... 474/109
5,307,672 A * 5/1994 Macchiarulo et al. ..... 73/118.1
5,689,067 A * 11/1997 Klein et al. ..... 73/118.1
5,733,214 A * 3/1998 Shiki et al. ..... 474/69
6,688,022 B1 * 2/2004 Hanafusa et al. ..... 474/109
6,849,011 B1 * 2/2005 Calfa et al. ..... 474/102

FOREIGN PATENT DOCUMENTS

EP 0237493 A1 * 9/1987
FR 2681617 A1 * 3/1993

* cited by examiner

*Primary Examiner*—Marcus Charles
(74) *Attorney, Agent, or Firm*—Epstein Drangel Baxerman & James, LLP; Robert L. Epstein

(57) ABSTRACT

A device serves to regulate the tension of a running belt. The belt is deflected on rollers of which one is designed as a force measuring roller and is connected to a displacement sensing device. This roller is provided with at least one force sensor that determines the force applied to the belt. In addition, this roller is position adjustably held by an actuating drive in order to be able to adjust the tension of the belt. The actuating drive is in an operative connection with a regulating device that is influenced by a correction device. This correction device determines the web tension from the force applied to the belt measured by the force sensor and from the position of the force measuring roller, that changes with the position of the tension regulating roller, and transmits this output as an actual value to the regulating device.

13 Claims, 2 Drawing Sheets

DEVICE AND METHOD FOR REGULATING THE TENSION OF A RUNNING WEB

BACKGROUND OF THE INVENTION

The invention is relative to a device for regulating the tension of a running belt and to a method for regulating the tension of a running belt.

Rotating screen belts for dewatering paper webs are known from practice. The paper web is pressed against the screen belt in order to press water out of the paper web. The rotating belt is deigned as an endless belt and rotates at the same speed as the paper web. In order to achieve a frictionless dewatering process, it is important that the rotating belt is loaded within certain tolerances with a given tensile stress. This is achieved by regulating the belt traction, in which instance one of the rollers is designed as a force measuring roller for determining the belt traction and one roller is designed as a tension regulating roller. The force measuring roller comprises a force sensor on each of the two opposed supports that measures the support force. The tension regulating roller is adjusted by a motor operator [servomotor, adjusting motor] in order to tension the rotating belt more or less. In order to achieve a closed control circuit the force sensors are in an operative connection with the tension regulating roller. In order to be able to determine the belt traction directly from the measured support force the rotating belt is deflected by 180° on the force measuring roller. The force measuring roller is looped in the same manner independently of the position of the actuating drive so that the measured support force directly reflects the belt traction. Due to the great looping of the force measuring roller it is necessary to grasp the belt on the inside and also on the outside. Thus, the side of the rotating belt contacted by the paper is also grasped by rollers so that particles from the paper web can accumulate on these rollers. These particles result in defects in the paper web and are therefore undesired.

The invention has the basic problem of creating a device and a method for regulating the tension of a running web that permits a precise regulation of the belt traction with a slight looping around the force measuring roller.

This problem is solved in accordance with the invention with the features of the present invention, as set forth in detail below.

DESCRIPTION OF THE INVENTION

The device of the invention serves to regulate the tension of a running web, especially of a rotating belt and in particular of a felt belt or screen belt of a cellulose manufacturing machine or paper manufacturing machine or a carding machine. It is advantageous if the rotating belt is deflected by as few rollers as possible, which rollers should grasp the rotating belt on the side not contacted by the paper if possible. However, this can only be accomplished if the rotating belt is deflected by less than 180° by each individual roller. In addition, it is necessary for a frictionless operation to maintain the tension of the rotating belt constant, which takes place by means of a tension regulating device. This device is influenced by at least one force sensor of a force measuring roller on which the rotating belt is deflected. The support force determined thereby is a measure for the belt traction. The regulating device acts on an actuating drive of an adjustable tension regulating roller that regulates the latter in accordance with the output signal of the regulating device. The problem results in this instance that a changed looping of the force measuring roller results on account of the adjusting of the tension regulating roller. Under these conditions the support force yields no unambiguous value for the belt tension so that the rotating belt is regulated to different belt tensions as a function of the tension regulating roller. In order to solve this problem a correcting device is associated with the force sensor that takes into consideration the looping of the force measuring roller. This correcting device calculates the belt traction from the support force and the looping of the force measuring roller and passes it on to the regulating device as an actual value. This assures that the regulating device regulates the belt tension to a constant value independently of the position of the tension regulating roller and therewith independently of the looping of the rotating belt resulting from it. This assures a uniform production quality in all operating states. In particular, it is immaterial if the belt is incorrectly deflected, especially as the value of the looping of the force measuring roller resulting from it is considered in the determination of the belt traction.

A particularly simple embodiment of the correcting device results if the correcting device is influenced by the position of the tension regulating roller and therewith by the particular position of the actuating drive. This position can be determined directly by a displacement pickup connected, e.g., to a drive shaft of the actuating drive, The displacement pickup determines the traversed path of the actuating drive so that the particular position of the tension regulating roller is known in every operating state. In the case of an incremental path determination at least one limit switch is associated with the actuating drive that assures a zero point adjustment of the path determination.

In order to further improve the correcting device, it is advantageous if the correcting device is influenced by the relative position of the force measuring roller relative to the adjacent rollers. In this instance the looping of the force measuring roller can be directly calculated from the position of the shafts [axes] of three rollers, one of which rollers can be adjusted by the actuating drive.

A simple embodiment of the correcting device results if the correcting device is associated with a storage device in which the positions of the fixed rollers are filed. It is completely sufficient to store the positions of those rollers that are adjacent to the force measuring roller since the other rollers have no influence on the looping of the force measuring roller. The looping of the force measuring roller and therewith the required correction factor for calculating the belt tensile stress can be readily determined from the known positions of the rollers adjacent to the force measuring rollers as well as from the force measuring roller itself.

Alternatively or additionally, it is advantageous if the correcting device is influenced by at least two force sensors of the force measuring roller. These force sensors act in different directions so that the bearing force of the force measuring roller is detected by them vectorially. In addition to the amount of the bearing force its direction can also be determined from this vectorial bearing force, from which direction the looping of the force measuring roller can be determined. In particular, it is not required that the exact positions of the adjacent rollers is known so that constructive changes of the roller design have no effect on the measured result.

In order to achieve a simple, economical design with a low incidence of trouble it is important to use as few deflection rollers as possible for the rotating belt. Basically, a pivotable web travel regulating roller is provided adjacent to two rollers that press the screen belt against the paper web, with the aid of which regulating roller the rotating belt is guided. In order to be able to function with as low a number of rollers as possible, it is advantageous if the tension regulating roller and the force measuring roller are formed by the same roller. As a result thereof, the force measuring roller is adjusted by the actuating drive, which results in a relatively large change of the looping by the rotating belt. However, this changing looping is sufficiently considered by the correcting device in order to achieve a reliable regulation of tension.

In order to assure an operation of the paper manufacturing machine with as low an incidence of trouble as possible, it is advantageous if all rollers grasp the same belt side, preferably the belt side not contacted by the paper web. This prevents particles that come loose from the paper web from collecting on the screen belt and resulting, when transferred onto the paper web, in a defect that can no longer be tolerated.

In the method of the invention a running web, especially a rotating belt, is deflected by rollers. At least one of the rollers is designed as a force measuring roller whose bearing force is measured. At least one of the rollers, preferably the force measuring roller, is designed at a tension regulating roller adjusted by an actuating drive. The adjusting of the tension regulating roller takes place by regulating the belt traction of the rotating belt. In order to use as few rollers as possible, that preferably grasp only one side of the rotating belt, the force measuring roller is looped around differently than the rotating belt upon an adjustment of the actuating drive so that the belt traction is no longer proportional to the measured bearing force. In order to nevertheless achieve an orderly regulation of traction for the rotating belt, the belt traction is calculated from the measured bearing force taking into consideration the particular looping of the force measuring roller. This results in an orderly regulation of the belt traction at every position of the tension regulating roller.

In order to achieve the lowest possible expense for the data processing, it is advantageous if the belt traction is calculated from the measured bearing force of the force measuring roller and a correction factor, This correction factor takes into consideration the positions of the individual rollers as well as the changing position of the tension regulating roller. The looping of the force measuring roller can be directly determined from these positions.

It is alternatively or additionally advantageous to determine the bearing force of the force measuring roller vectorially. The looping of the force measuring roller by the belt is calculated thereby from the direction of the bearing force in order to determine the correction factor for the belt traction. This results in a calculation of the belt traction that is substantially independent of the belt geometry.

In addition, it is advantageous for determining the looping of the force measuring roller to detect the position of the belt with a sensor. The sensor is preferably formed by a roller resiliently pressed against the rotating belt. The looping of the force measuring roller can be directly determined from the position of the roller. Alternatively, it is also conceivable to use a contactless sensor, e.g., an ultrasound sensor, that detects the position of the belt.

Finally, it is advantageous if the force measuring roller is associated with a winder. The web side leaving the force measuring roller is supplied directly to the winder so that its angular position correspondingly changes as a function of the diameter of the roll. The resulting change of the looping of the force measuring roller is corrected thereby so that the web force can be determined sufficiently precisely. Since no other rollers are provided between the force measuring roller and the winder the web traction in the area of the winder can be determined with especially high accuracy in this manner and corrected by regulating of the web tension.

Other advantages and features of the present invention are presented in the following detailed description using the associated figures containing several exemplary embodiments of the present invention. However, it should be understood that the drawings serve only to show the invention and do not limit the scope of the protection of the invention.

DETAILED DESCRIPTION OF THE DRAWINGS

Figure 1:
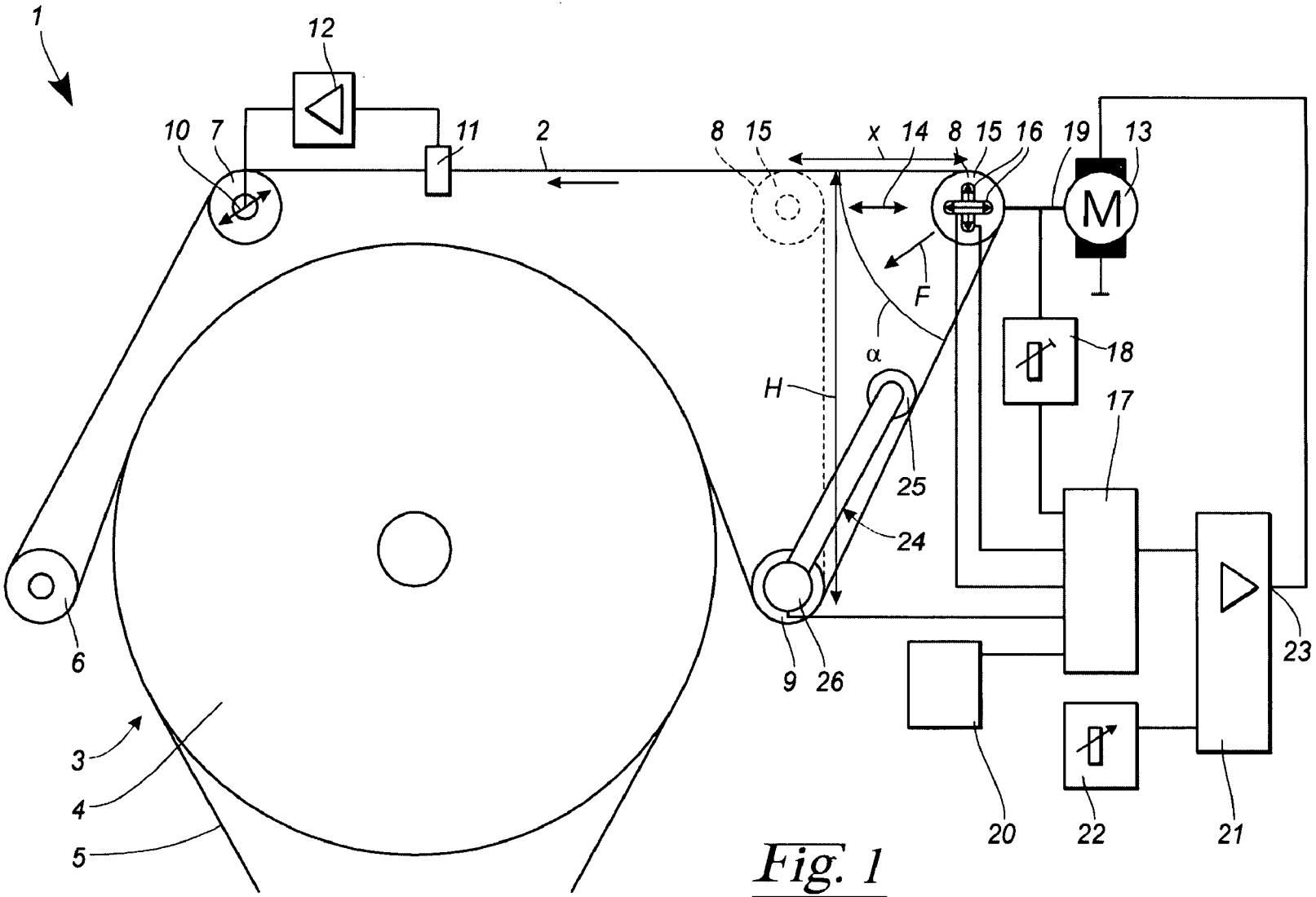
FIG. 1 shows a schematic view of a first embodiment of a device for regulating the tension of a belt.

FIG. 1 shows a schematic representation of a first embodiment of a device 1 for regulating the tension of a rotating belt 2. Belt 2 is formed in this exemplary embodiment by a screen belt of dewatering device 3 of a paper manufacturing machine. Dewatering device 3 comprises rotatable drum 4 around which wet paper web 5 loops. Belt 2 is pressed on the outside against paper web 5 so that paper web 5 is held between screen belt 2 and drum 4. Belt 2 is under a given tensile stress in order to achieve the desired dewatering effect for paper web 5. The excess water contained in paper web 5 is pressed through screen belt 2 on account of the pressure on the screen belt. Several dewatering devices 3 are arranged in series in order to achieve a sufficient dewatering effect.

Belt 2 is deflected by four rollers 6, 7, 8, 9. Rollers 6, 9 are designed to be fixed in their axial position and therefore function as pure deflection rollers 6, 9. Roller 7 is supported in such a manner that it can pivot in the direction of arrow 10 and forms a belt travel regulating roller. Belt 2 can be influenced in its direction of travel by pivoting belt travel regulating roller 7. This is important for holding belt 2 in position. To this end edge sensor 11 is provided that detects the position of belt 2 and supplies it to belt travel regulator 12. This belt travel regulator compares the signal emitted by edge sensor 11 with a theoretical value and controls an actuating drive (not shown) of belt travel regulating roller 7 in a corresponding manner. A regulation of belt travel is achieved in this manner.

In order to adjust the desired traction of rotating belt 2 tension regulating roller 8 can be adjusted by actuating drive 13 in the direction of arrow 14. The further tension regulating roller 8 is moved to the right from the position indicated in dotted lines the greater the traction introduced into belt 2 becomes.

In order to be able to function sufficiently with as few rollers 6, 7, 8, 9 as possible, tension regulating roller 8 is designed at the same time as force measuring roller 15. To this end force measuring roller 15 is provided on each of its two supports with orthogonally situated force sensors 16 that measures the support force. These force sensors 16 determine the support force of force measuring roller 15 in two directions standing vertically relative to one another so that in addition to the amount of the bearing force its direction can also be determined. Force sensors 16 are in an operative connection with correction device 17 that calculates the belt traction from the measured vectorial bearing force F. Correction device 17 calculates the following expression for the belt tensile stress S from the values determined by force sensors 16:

$$s = \frac{|\overline{F}|}{\sqrt{2 + 2\cos(2a)}}$$

In this equation F is the amount of the determined bearing force F and a is the angle between the measured direction of force and the direction of belt travel between rollers 7, 8. The direction of adjusting tension regulating roller 8 is selected to be parallel to the direction of belt travel between rollers 7, 8 for the sake of simplifying the exemplary embodiment so that a simple geometric condition for calculating belt traction F results.

Alternatively or additionally, this correcting device 17 is in an operative connection with displacement pickup 18 that detects the particular position of actuating drive 13. Displacement pickup 18 is preferably in an operative connection with drive shaft 19 of actuating drive 13. Correcting device 17 receives a signal through this connection that reflects the position of tension regulating roller 8. Correcting device 17 is associated with storage device 20 in which the positions of rollers 7 and 9 are filed. In this manner the positions of rollers 7, 8 and 9 are known to correcting device 17 so that the entrance and exit angles of belt 2 to force measuring roller 8 can be determined by simple trigonometric calculations. Angle a of the support force direction is calculated as $$a = \tfrac{1}{2}\arctan H/x$$

In this equation H denotes the difference in height between rollers 8 and 9 in vertical projection onto the belt plane between rollers 7 and 8 and x denotes the particular position of tension regulating roller 8 relative to the position of deflection roller 9. The position x=0 therefore corresponds to the position of tension regulating roller 8 at which it comes to rest congruently vertically to the plane of the rotating belt, viewed between rollers 7 and 8. This position is shown in dotted lines. The belt traction can be directly determined therewith from the measured support force F, the position of rollers 7, 9 and the particular position x of tension regulating roller 8.

Sensor 24 is alternatively or additionally provided that detects the side of the rotating belt running to force measuring roller 15. Basically, the side of rotating belt 2 running off force measuring roller 15 could also be detected; however, this is not necessary in the exemplary embodiment since the position of this side is independent of the position of tension regulating roller 8.

Sensor 24 comprises a pivotally supported, freely rotatable roller 25 pressed resiliently against rotating belt 2. Moreover, sensor 24 comprises potentiometer 26 that detects the pivotal position of roller 25 and converts it into an electric signal. This electric signal is proportional to the looping (that is, angle a) of force measuring roller 15 and is supplied to correcting device 17.

Correcting device 17 is in an operative connection with regulating device 21 that receives the belt traction determined by correcting device 17 as an actual value and compares it with a theoretical value of theoretical value detector 22. Regulating device 21 preferably has a PID behavior and acts with its output 23 on actuating drive 13. In this manner the desired tensile stress of the belt can be adjusted by adjusting the theoretical value outputted by theoretical value detector 22, which stress is subsequently stabilized by adjusting tension regulating roller 8.

Figure 2:
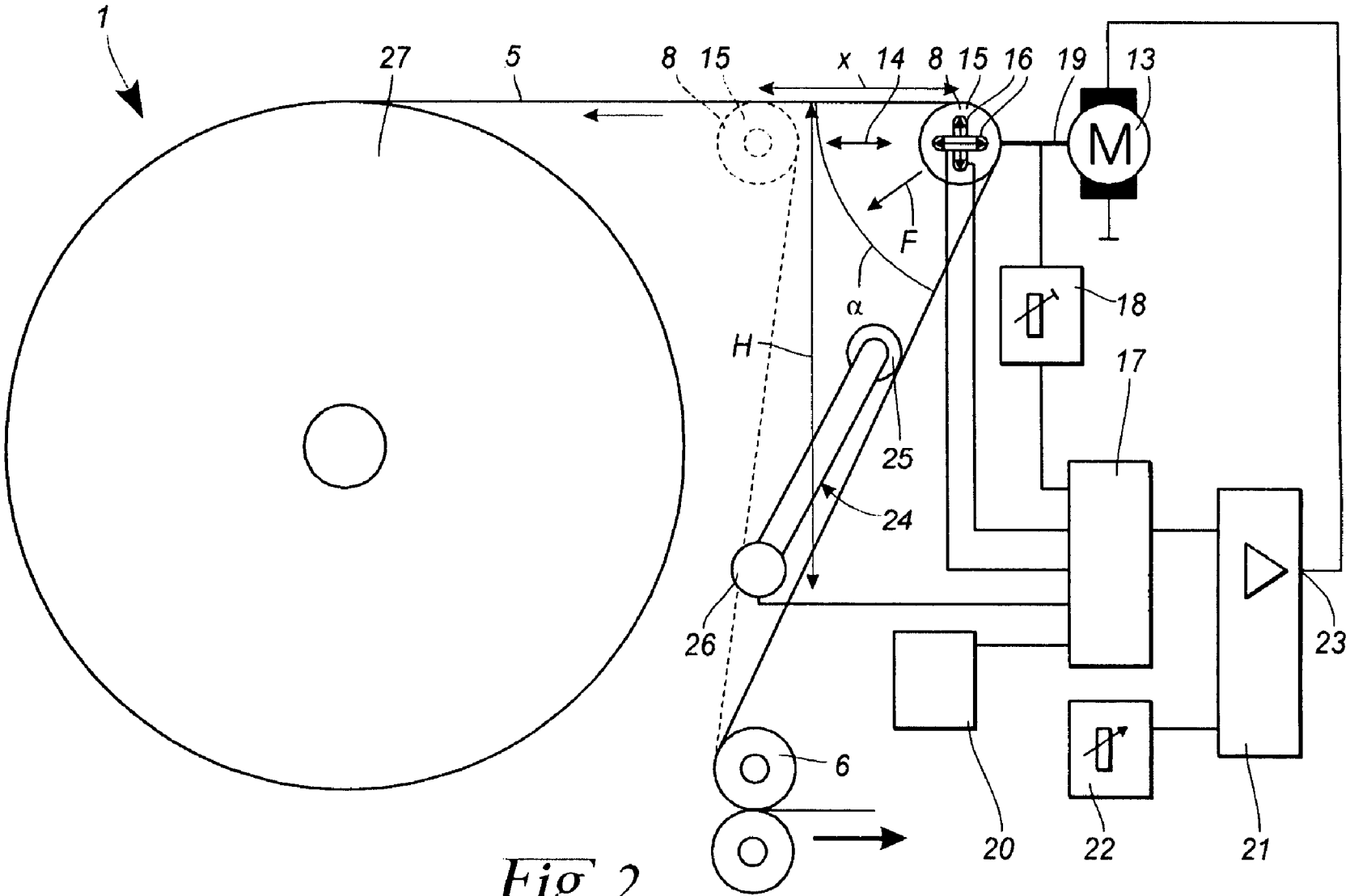
FIG. 2 shows a schematic view of a second embodiment of a device for regulating a web.

FIG. 2 shows a schematic view of a second embodiment of the device according to FIG. 1 and the same reference numerals name the same parts. Only the differences from the embodiment of FIG. 1 are explained in the following. Device 1 according to FIG. 2 serves to detect and regulate the tension of a running web 5 that is deflected via rollers 6, 15 and is wound onto winder 27. Given the reverse direction of web travel, winder 27 could also be used as an unwinder.

Roller 15 is designed as a force measuring roller whose bearing forces are detected vectorially with the aid of orthogonally acting force sensors 16. Force measuring roller 15 can be adjusted in the direction of arrow 14 by actuating drive 13 in order to adjust the desired tension of belt 2, as shown in FIG. 1, or the web 5, as shown in FIG. 2.

As shown in FIG. 2, looping angle a of force measuring roller 15 is determined on the one hand by the position of force measuring roller 15 and on the other hand by the diameter of winder 27. This diameter changes as a function of the progress of the winding or unwinding process. Nevertheless, the web traction can be determined sufficiently precisely by virtue of the vectorial detection of the bearing force of force measuring roller 15.

Since a few exemplary embodiments of the present invention were not shown or described, it is to be understood that a plurality of changes and modifications of these described exemplary embodiments is possible without departing from the essential concept and the protective range of the invention fixed by the claims.

LIST OF REFERENCE NUMERALS

1 device
2 belt
3 dewatering device
4 drum
5 paper web
6 deflection roller
7 belt travel regulating roller
8 tension regulating roller
9 deflection roller
10 arrow direction
11 edge sensor
12 belt travel regulator
13 actuating drive
14 arrow direction
15 force measuring roller
16 force sensor
17 correcting device
18 displacement pickup
19 drive shaft
20 storage device
21 regulating device
22 theoretical value detector
23 output
24 sensor
25 roller
26 potentiometer
27 winder
F bearing force
H roller interval
x position
a looping angle

The invention claimed is:

1. A device for regulating the tension of a belt for pressing a web against the surface of a rotating drum in which the belt is deflected on rollers of which at least one comprises a force measuring roller, said force measuring roller comprising at least one force sensor for measuring the force applied by said force measuring roller on said belt and in which at least one of the rollers comprises a tension regulating roller position adjustably held by an actuating drive in an operative connection with said force sensor via a regulating device, said force sensor being in an operative connection with a correcting device that calculates the traction of said belt based on said force applied by said force measuring roller on said belt and a value dependent on the position of said force measuring roller and wherein the output of said correcting device is used by said regulating device in order to adjust the position of said force measuring roller.

2. The device according to claim 1, wherein said connecting device is influenced by the position of said tension regulating roller.

3. The device according to claim 1 or 2, wherein some of said rollers are adjacent to said force measuring roller and wherein said correcting device is influenced by the relative position of the force measuring roller and said adjacent rollers.

4. The device according to claim 3, wherein the positions of said adjacent rollers are fixed and wherein said correcting device is associated with a storage device in which at least the positions of the said rollers adjacent to said force measuring roller are fixed.

5. The device according to claims 1, wherein said the correcting device is influenced by at least two force sensors of the force measuring roller that vectorially detect the bearing force of the force measuring roller in order to calculate the position of the force measuring roller.

6. The device according to claims 1, wherein said tension regulating roller and said force measuring roller comprises a single roller.

7. The device according to claim 1, wherein all of said rollers act on the same belt side.

8. The device according to claim 1 wherein said belt comprises a belt for use in a cellulose dewatering machine, paper manufacturing machine or carding machine.

9. A method for regulating the tension of a running belt for pressing a web against the surface of a rotating drum, in which the belt is deflected by rollers at least one of which comprises a force measuring roller that applies a force against the belt that is being measured and in which at least one of the rollers comprises a tension regulating roller that is adjusted by an actuating drive by regulating the belt traction, said method comprising the step of positioning the force measuring roller differently during the adjusting of the actuating drive, during which the belt traction is calculated from the measurement of the force applied to the belt by the force measuring roller and a value dependent on the position of the force measuring roller.

10. The method according to claim 9, further comprising the step of calculating the web traction from the measured force applied on the force measuring roller and a correction factor that is influenced by the positions of the rollers as well as by the changing position of the tension regulating roller.

11. The method according to claim 10, further comprising the step of scanning the belt by at least one sensor that generates a signal dependent on the position of the force measuring roller.

12. The method according to claim 9, further comprising the steps of determining the force applied to the belt by the force measuring roller vectorially and calculating the position of the force measuring roller from the direction of the applied force in order to determine a correction factor for calculating the web traction from the measurement of the applied force.

13. The method according to claim 9, wherein said belt comprises a belt for use in a cellulose dewatering machine, paper manufacturing machine, or a carding machine.

* * * * *